US006502295B1

(12) United States Patent
Morgand

(10) Patent No.: US 6,502,295 B1
(45) Date of Patent: Jan. 7, 2003

(54) METHOD OF THE BUTTONING TYPE FOR ASSEMBLING SHEETS TOGETHER WITHOUT WELDING

(75) Inventor: Jean Pierre Morgand, Bouret sur Canche (FR)

(73) Assignee: Coparl, S.A., Ailly sur Noye (FR)

( * ) Notice: Subject to any disclaimer, the term of this patent is extended or adjusted under 35 U.S.C. 154(b) by 0 days.

(21) Appl. No.: 09/723,850

(22) Filed: Nov. 28, 2000

(30) Foreign Application Priority Data

Dec. 15, 1999 (FR) ..... 99.15843

(51) Int. Cl.[7] ..... B21D 39/00
(52) U.S. Cl. ..... 29/509; 29/512; 29/521
(58) Field of Search ..... 29/509, 512, 521, 29/523

(56) References Cited

U.S. PATENT DOCUMENTS

| | | | | | |
|---|---|---|---|---|---|
| 2,228,930 | A | * | 1/1941 | Robinson | 493/392 |
| 2,305,197 | A | * | 12/1942 | Sheridan | 285/202 |
| 2,321,755 | A | * | 6/1943 | Kost | 52/592.3 |
| 2,415,695 | A | * | 2/1947 | Kann | 411/180 |
| 3,282,317 | A | * | 11/1966 | Zahodiakin | 411/179 |
| 3,369,289 | A | * | 2/1968 | Gapp | 29/512 |
| 3,502,130 | A | * | 3/1970 | Gulistan | 411/361 |
| 3,828,851 | A | | 8/1974 | Johnson | |
| 4,699,212 | A | * | 10/1987 | Anderson et al. | 165/167 |
| 5,203,812 | A | * | 4/1993 | Eckold et al. | 29/522.1 |
| 5,868,356 | A | * | 2/1999 | Giedris | 244/132 |

FOREIGN PATENT DOCUMENTS

| | | | | |
|---|---|---|---|---|
| DE | 28 22 051 | | 11/1979 | |
| DE | 93 06 396 | | 8/1993 | |
| DE | 42 43 620 | | 6/1994 | |
| DE | 198 10 367 | | 8/1999 | |
| EP | 383993 | * | 8/1990 | F16B/5/00 |
| FR | 2371252 | * | 6/1978 | B21D/39/02 |
| FR | 2565871 | * | 12/1985 | B23P/11/00 |
| GB | 1285992 | * | 8/1972 | 29/512 |
| GB | 2079883 | * | 1/1982 | 29/512 |

* cited by examiner

*Primary Examiner*—S. Thomas Hughes
*Assistant Examiner*—Essama Omgba
(74) *Attorney, Agent, or Firm*—Wolf, Greenfield & Sacks, P.C.

(57) ABSTRACT

A method of assembling together, without welding, first and second pieces of plastically deformable material, said method comprising: in a first step, making a rim hole in the first piece, the hole having a rim with an inside diameter D2*i* and an outside diameter D2*e;* a step of making a counterbored hole having two successive diameters in the second piece, said counterbored hole having a first section of small diameter d8 and a second section of large diameter D8, the small diameter d8 being greater than the outside diameter D2*e* of the rim; a step of inserting said rim into said counterbored hole, an annular gap being defined between the outer annular face of the rim and the inner annular face of the second section of the counterbored hole; and a step of deforming the end portion of the rim so as to occupy at least part of the annular gap; said method comprising prior to the step of deforming the end portion of the rim, a step of inserting centering means in the rim hole, the centering means having a diameter Dc, where Dc=d8−(D2*e*−D2*i*), the axis of the centering means being maintained in a predefined reference position.

11 Claims, 3 Drawing Sheets

METHOD OF THE BUTTONING TYPE FOR ASSEMBLING SHEETS TOGETHER WITHOUT WELDING

The invention relates to the technical field of assembling sheets without welding.

BACKGROUND OF THE INVENTION

Various methods are already known in the prior art for assembling sheets without welding.

Of those methods, particular mention can be made of embedding, stapling, riveting, adhesive, bolting, and crimping.

The present invention relates more particularly to assembling sheets by crimping.

The term "crimping" is used to mean mechanical assembly in which at least one of the members is locally deformed in permanent manner.

Crimping makes it possible to assemble together a wide variety of materials that are not usually assembled together such as, for example, plastics materials, leather, glass, wood, copper alloy, aluminum alloy.

The invention relates more particularly, but not exclusively, to assembling together metal or metal alloy sheets by crimping.

Various crimping methods of that type are already known in the prior art.

By way of example, reference can be made to the following documents: EP 0 383 993; FR-A-2 565 871; and FR-A-2 371 252.

Document FR-A-2 371 252 describes a method of assembling together two pieces which are in contact via a surface that is plane or that has a small amount of curvature that is regular, at least one of the pieces being a plate or a sheet of a ductile material such as a metal.

In that known prior art method, a bore having two successive diameters is provided in one of the pieces, the smaller diameter being on the side that is in contact with the plate or sheet to be assembled with said piece, said plate or sheet being provided with a bore of diameter that is smaller than the smaller of the diameters in the bore of the piece.

After placing the two bores so that they are in axial alignment, the metal situated in the vicinity of the bore in the plate or the sheet is driven into the bore of the piece to be fixed and at least as far as the larger portion of said bore.

The method described in document FR-A-2 371 252 is more particularly intended for fixing a reinforcing washer onto a sheet of mild steel.

The washer is fixed in place by driving metal of the washer into the bore in the sheet.

The assembly method described in document FR-A-2 371 252 is very suitable when the assembly formed by the washer, the sheet, the backing die, and the punch is in accurate axial alignment, however if any one of those elements is not properly on the axis relative to the others, then the fixing that is obtained will be faulty both functionally and in terms of appearance.

More precisely, in the apparatus described in document FR-A-2 371 252, when there is an axial offset of about one-tenth of a millimeter between the washer and the sheet, then the consequences can be as follows:

- the punch stretches the metal of the washer more on one side of its bore than on the other;
- in the portion where the metal of the washer is more greatly stretched, the volume of material that is displaced can be greater than the design volume provided in the bore in the sheet;
- the punch which has a cylindrical portion for calibrating the diameter of the final hole will push the surplus material into the die piece and cut off said surplus material, giving rise to an irreparable and unacceptable burr caused by the operating clearance between the die and the punch; and
- conversely, in the portion where the metal is deformed insufficiently, the volume of displaced material is smaller than the design volume provided in the bore in the sheet and insufficient for completely filling the bottom portion of the bore. This defect reduces tear-out strength.

OBJECTS AND SUMMARY OF THE INVENTION

A first object of the invention is to provide a crimping assembly method of the buttoning type that leads to no loss of tear-out strength between the two assembled-together parts in the event of said assembly being performed in the presence of an alignment fault.

A second object of the invention is to provide a method of assembling together two sheets that does not require an additional piece and that makes it possible with a small number of operations to obtain accurate fixing of the two pieces relative to each other while guaranteeing that the fixing system proper can accommodate the clearance necessary for accurate positioning of the two pieces to be assembled together without the fixing suffering as a result from poor tear-out strength or poor appearance.

To this end, in a first aspect, the invention provides a method of assembling together, without welding, first and second pieces of plastically deformable material such as a ductile metal or metal alloy, said method comprising:

- in a first step, making a rim hole in the first piece, the hole having a rim with an inside diameter D2*i* and an outside diameter D2*e*, and extending along an axis substantially perpendicular to the local mean plane of the first piece;
- a step of making a counterbored hole having two successive diameters in the second piece, said counterbored hole extending along an axis substantially perpendicular to the local mean plane of the second piece, said counterbored hole having a first section of small diameter d8 and a second section of large diameter D8, the small diameter d8 being greater than the outside diameter D2*e* of the rim by a "clearance" value;
- a step of inserting said rim into said counterbored hole, an annular gap being defined between the outer annular face of the rim and the inner annular face of the second section of the counterbored hole; and
- a step of deforming the end portion of the rim so as to occupy at least part of the annular gap;

said method comprising prior to the step of deforming the end portion of the rim, a step of inserting centering means or "center punch" in the rim hole, the centering means having a diameter Dc equivalent to that of the first section of the counterbored hole minus twice the thickness of the rim, i.e.:

$$Dc = d8 - (D2e - D2i)$$

the axis of the centering means or being maintained in a predefined reference position.

According to a particular characteristic, the method is such that the dimensions of the rim hole and of the counterbored hole are predetermined so that the portion of the rim which is pressed into the counterbore:

always bears against the counterbore;

always extends beyond the small diameter d8 of the first section of the counterbored hole; and does not extend beyond the larger diameter D8 of the second section of the counterbored hole; even when the axes of the rim hole and of the counterbored hole are in their position of maximum offset.

In various implementations, the present method includes the following characteristics, taken singly or in combination:

the step of inserting the centering means is performed after holding the first piece in position relative to the second piece;

the first piece and the second piece are held in contact during insertion of the centering means via respective substantially plane surfaces disposed around the rim hole and the counterbored hole;

the first piece and the second piece are held in contact during insertion of the centering means via respective surfaces having a small amount of regular curvature disposed around the rim hole and the counterbored hole;

the rim hole is deformed by cold deformation;

the counterbored hole is obtained by cold deformation;

the counterbored hole is circular; and the counterbored hole is oblong.

BRIEF DESCRIPTION OF THE DRAWINGS

Other objects and advantages of the invention will appear on reading the following description of implementations, which description is made with reference to the accompanying drawings, in which:

FIG. 5 is a diagram relating to repositioning the axis of the rim hole in the positioning clearance provided in the counterbored hole, in which:

Figure 4:
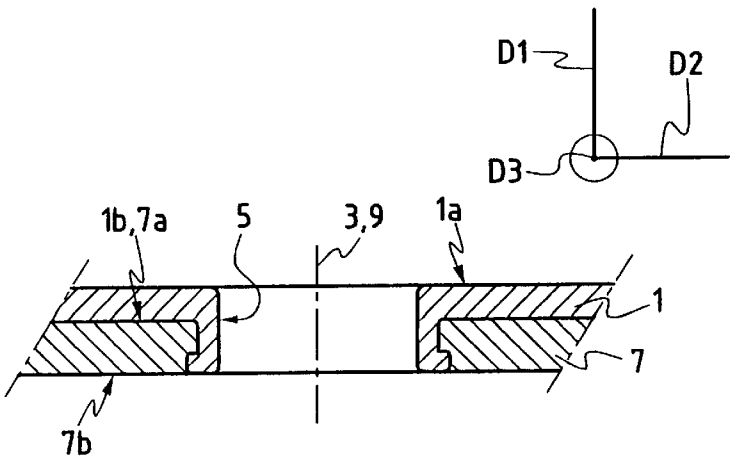
FIG. 4 is a cross-section view analogous to FIG. 3, after the rim has been pressed down.
Figure 3:
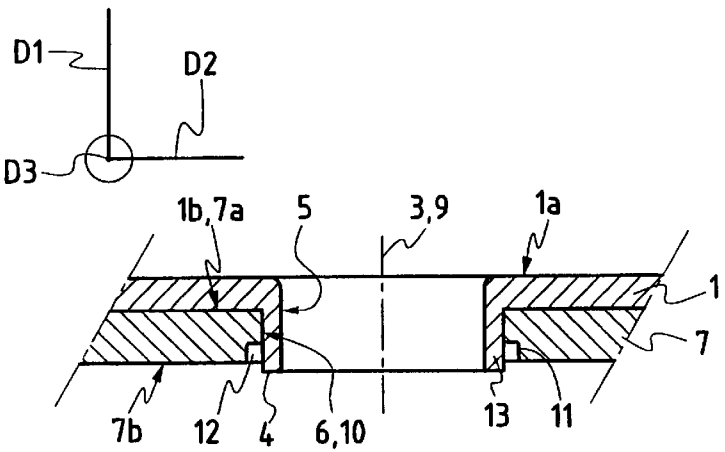
FIG. 3 is a cross-section view through an assembly formed by the first piece and the second piece after the rim hole has been inserted into the counterbored hole.
Figure 5A:
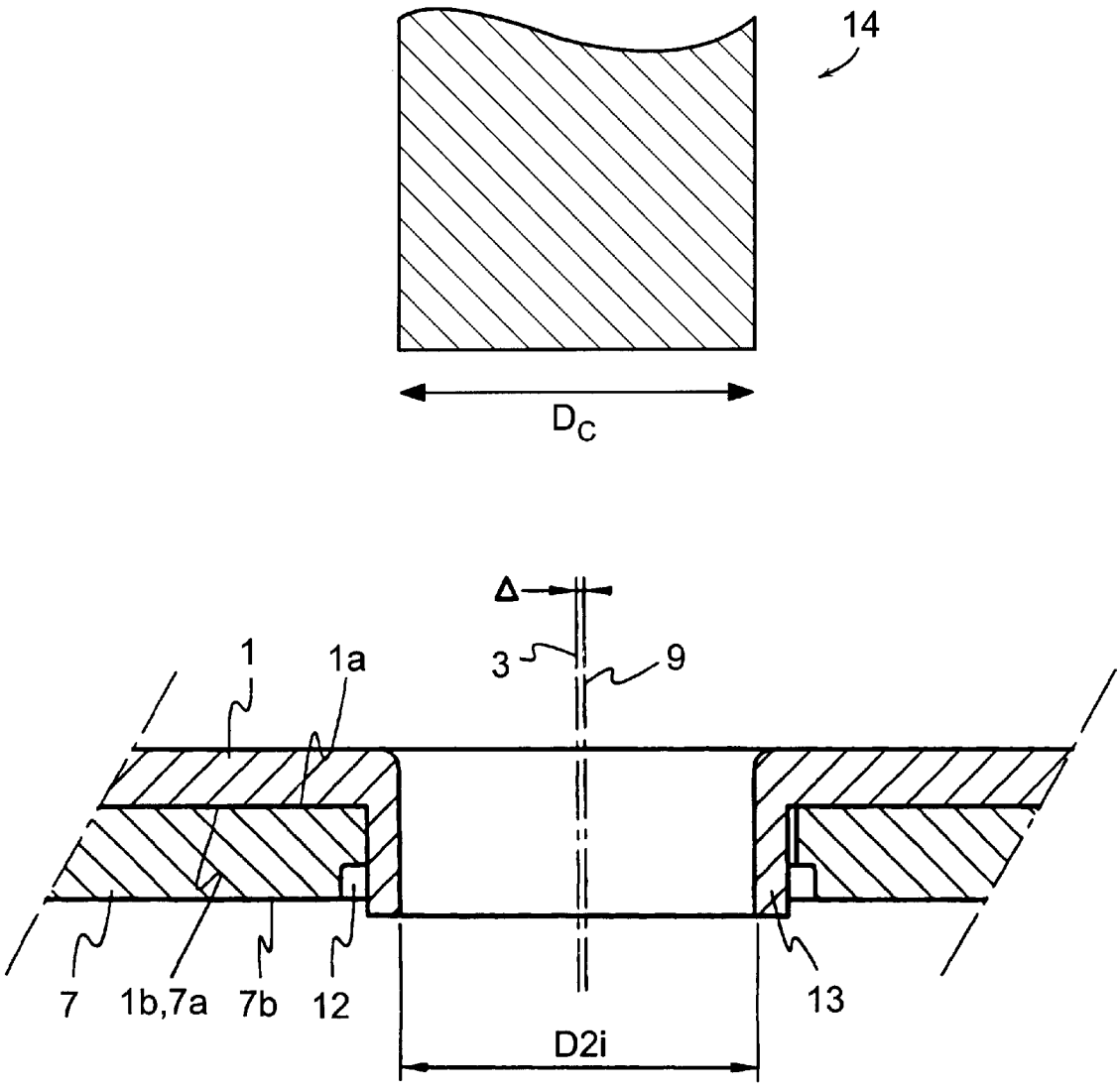
Figure 5B:
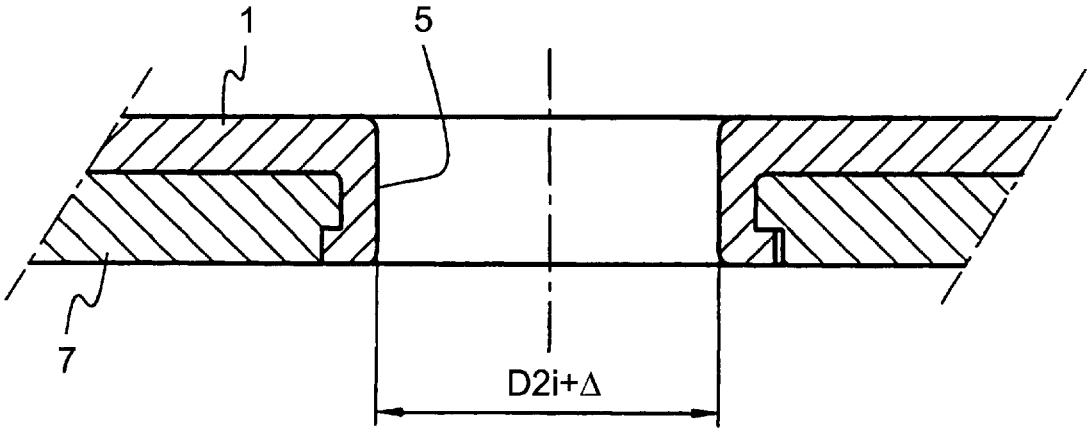
Figure 5C:
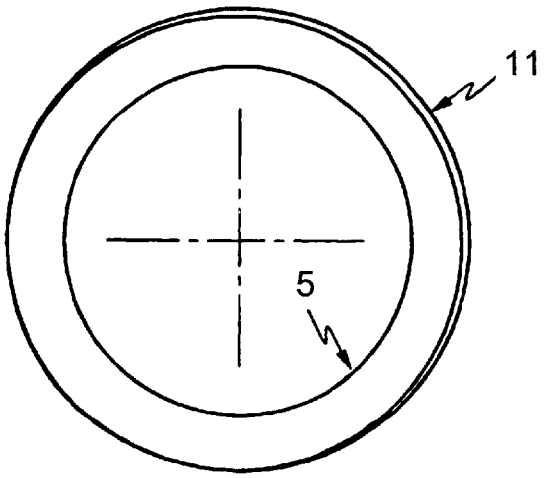

portion A of FIG. 5 is a view analogous to FIG. 3, but in which the axes of the rim hole and of the counterbored hole are not in alignment, but are offset by a value Δ;

portion B of FIG. 5 is a view analogous to FIG. 4 but in which the axis offset between the rim hole and the counterbored hole has led in the method of the invention to the pressed-down rim of the rim being off-center relative to the counterbored hole, with this controlled off-centering having no impact on the tear-out strength of the crimped assembly; and portion C of FIG. 5 is an underview corresponding to portion B.

MORE DETAILED DESCRIPTION

Figure 1:
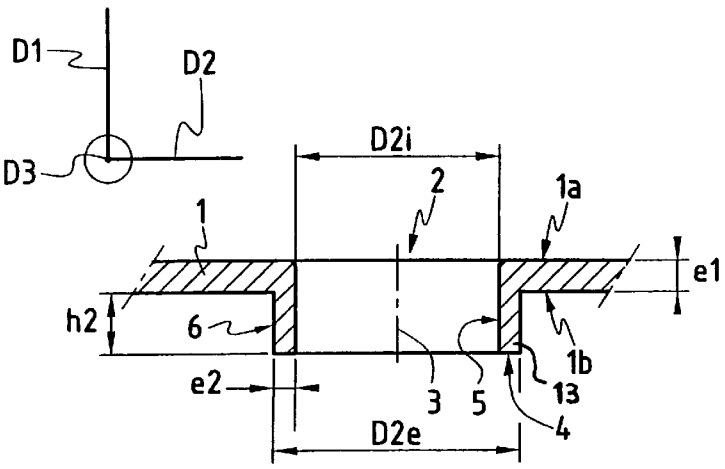
FIG. 1 is a section view through a first piece of metal or metal alloy after a rim hole has been made.

Reference is made initially to FIG. 1.

FIG. 1 is a fragmentary section view of a first piece 1 of metal or metal alloy.

This first piece 1 has a rim hole 2 with an axis 3.

The plane of FIG. 1 is defined by a first direction D1 referred to as a "longitudinal" direction which is substantially parallel to the axis 3, and by a second direction D2. A third direction D3 perpendicular to the plane of FIG. 1 forms a rectangular frame of reference in association with the directions D1 and D2.

In the text below:

the terms "longitudinal", "height", "upper", "lower", etc. are employed with reference to the first direction D1;

the terms "transverse", "cross", etc. are used with reference to the family of planes defined by the directions D2 and D3.

In the implementation shown, the first piece 1 presents a top face la which, at least around the hole 2, is substantially plane and parallel to a bottom face 1*b*.

In other implementations (not shown) the top and/or bottom face of the first piece can present a small amount of regular curvature.

In the implementation shown, the rim hole 2 is circularly symmetrical about the axis 3 which is substantially perpendicular to the mean plane of the first piece 1.

In other embodiments (not shown), the rim hole 2 can be oblong.

The height h2 of the rim 13 of the hole 2 is defined as being the distance between the bottom face 1*b* of the first piece 1 and the transverse free end edge 4 of the rim 13.

The inner annular face 5 of the hole 2 is substantially cylindrical about the axis 3 in the embodiment shown, and it is defined by an inside diameter D2*i*.

Similarly, the outer annular face 6 of the rim 13 is substantially cylindrical about the axis 3 in the implementation shown, and it defines an outside diameter D2*e*.

The difference D2*e*–D2*i* between the outside and inside diameters of the rim hole correspond to twice the radial thickness e2 of the rim 13, which is less than the thickness e1 of the first piece 1 as measured in the vicinity of the hole 2.

Figure 2:
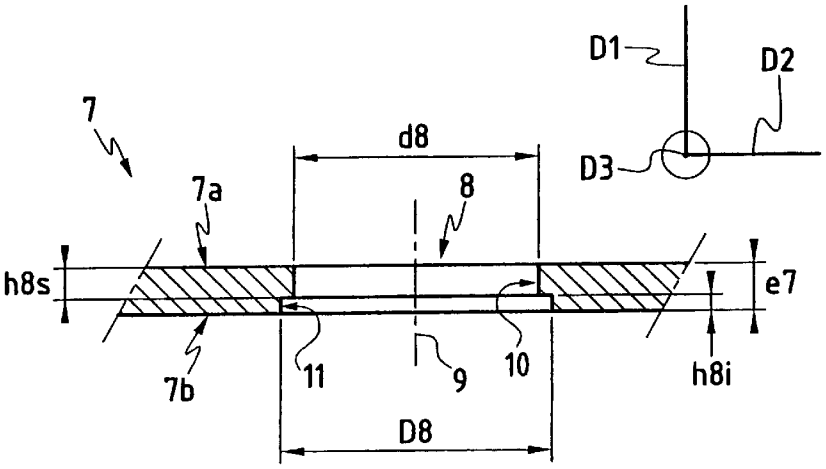
FIG. 2 is a section view through a second piece of metal or metal alloy after a counterbored hole has been made.

Reference is now made to FIG. 2.

A second piece 7, shown in section in FIG. 2, is provided with a counterbored hole 8 having an axis 9 that is substantially perpendicular to the main plane in which said second piece 7 extends.

The three reference directions D1, D2, and D3 as defined above with reference with FIG. 1 is used again for reference in describing the second piece 7, which second piece 7 is to be assembled to the first piece 4.

Thus, the plane of FIG. 2 is defined by the direction D1 and D2, with the first direction D1 being substantially parallel to the axis 9.

In the implementation shown, at least around the counterbored hole 8, the second piece 7 has a top face 7*a* that is substantially plane and parallel to a bottom face 7*b*.

In other implementations (not shown), the top and/or bottom face of the second piece can present a small amount of regular curvature.

In a first or upper section that is annular about the axis 9, the counterbored hole 8 has a small diameter d8 extending over a height h8*s*.

The counterbored hole has a second or lower section that is annular about the axis 9, with a large diameter D8, that extends over a height h8*i*.

The thickness e7 of the second piece 7 is substantially equal to the sum h8*s*+h8*i*, at least in the vicinity of the counterbored hole 8.

Reference is now made to FIG. 3.

As shown in FIG. 3, when the rim 13 of the first piece 1 is inserted in the counterbored hole 8 of the second piece 7:

the bottom face 1*b* of the first piece 1 is substantially in contact, at least in the vicinity of the counterbored hole 8, with the top face 7*a* of the second piece 7;

the transverse annular edge 4 of the rim 13 projects beyond the mean plane defined by the bottom face 7*b* of the second piece 7;

the axis 3 of the rim hole 2 coincides substantially with the axis 9 of the counterbored hole 8;

the outer annular face 6 of the rim 13 faces and comes at least locally into contact with the inner annular face 10 of the top first section of the counterbored hole 8; and the outer annular face 6 of the rim 13 faces and is at a distance from the inner annular face 11 of the bottom second section of the counterbored hole 8, with an annular gap 12 of predetermined volume being defined between the faces 6 and 11.

As can be seen in FIG. 4, this annular gap 12 is filled by deforming the material forming the bottom end portion of the rim 13.

In FIGS. 3 and 4, the axes 3 and 9 of the rim hole 2 and of the counterbored hole 8 are shown as being in alignment.

That situation is far from being the most common, in particular when the pieces 1 and 7 are obtained by cold deformation at high rates of throughput.

When the first piece 1 and the second piece 7 are disposed in such a manner that the axes 3 and 9 of the rim hole 2 and of the counterbored hole 8 are not exactly in alignment, then conventional methods give rise to faulty appearance such as burrs, cut-off material, and even reduced tear-out strength, as explained above with reference to document FR-A-2 371 252.

The method of the invention enables these drawbacks to be avoided.

The method of the invention implements a center punch 14 of diameter Dc defined as the diameter d8 of the first section of the counterbored hole minus twice the rim thickness e2, i.e. Dc=d8−2e2.

The axis of the center punch is maintained in a reference position.

On penetrating into the rim hole 2, the center punch enables the axis 3 of the hole 2 to be moved within the positioning clearance provided for this purpose.

The rim 13 of the hole 2 is then pressed down into the counterbore so as to avoid exceeding the diameter thereof, even when positioned at maximum clearance between the first and second pieces.

The punch too is then withdrawn. Fixing is then provided by a pressed-down rim which presents no extra thickness and no burring, having a calibrated bore of shiny appearance, and the two assembled-together pieces present planeness to within 5/100ths of a millimeter.

All of the above operations can be performed using a cold deformation press.

The method can be implemented for pieces 1 and 7 that are obtained by stamping using a press that reproduces dimensions to within ±0.05 mm.

The offsets between the axes 3 and 9 of the two pieces 1 and 7 to be assembled together can be of the order of ±0.10 mm.

Such an offset Δ is represented in portion A of FIG. 5. After the rim 13 of the hole 2 has been deformed, as shown in portions B and C of FIG. 5, the surplus material or the lack of material resulting from the alignment error becomes an off-center error for the outside diameter of the rim pressed down into the counterbore of the second piece 7.

This defect in appearance does not give rise to a drop in tear-out strength.

The rim hole is dimensioned to enable positioning clearance between the two pieces 1 and 7 to be accommodated, with this accommodation being obtained by the off-centering of the outside diameter of the rim pressed down relative to the diameter D8, without giving rise to any extra thickness or to burring.

The center punch can thus be maintained in a predetermined position corresponding, for example, to the design dimensions for the assembly obtained by crimping together the two pieces 1 and 7, these dimensions thus being independent of crimping conditions.

Example

A first piece 1 made of metal or metal alloy having a thickness e1 equal to 2 mm had a rim hole 2 made therein so as to obtain, after fixing to a second piece 7, a hole with an inside diameter of 12.1 mm ±0.05 mm.

It is necessary for the center of such a hole to be positioned within ±0.05 mm relative to a reference that is fixed relative to one of the two pieces 1 and 7.

The rim hole 2 had an inside diameter D2*i* of 11.90 mm, an outside diameter D2*e* of 14.50 mm, and the rim extended over a height h2 of 3.50 mm.

The second piece 7 of thickness e7 equal to 3 mm for assembly without welding to the first piece 1 had a counterbored hole 8 in which:

the top, first section had a small diameter d8 of 14.70 mm and extended over a height h8*s* of 1.9 mm; and the bottom, second section had a large diameter d8 of 16 mm and extended over a height h8*i* of 1.1 mm.

The two pieces 1 and 7 were positioned accurately and held by a center punch having an outside diameter Dc given by:

$$Dc=d8-2e2=d8-(D2e-D2i), \text{ i.e.}$$

$$Dc=14.70-(14.50-11.90)=12.10 \text{ mm.}$$

The rim 13 was then pressed down into the counterbore.

What is claimed is:

1. A method of assembling together, without welding, first and second pieces of plastically deformable material, said method comprising:

making a rim hole in the first piece, the hole having a rim with an inside diameter D2*i* and an outside diameter D2*e*, and extending along an axis substantially perpendicular to a local mean plane of the first piece;

making a counterbored hole having two successive diameters in the second piece, said counterbored hole extending along an axis substantially perpendicular to a local mean plane of the second piece, said counterbored hole having a first section of small diameter d8 and a second section of large diameter D8, the small diameter d8 being greater than the outside diameter D2*e* of the rim by a clearance value;

inserting said rim into said counterbored hole, an annular gap being defined between an outer annular face of the rim and an inner annular face of the second section of the counterbored hole; and deforming an end portion of the rim so as to occupy at least part of the annular gap;

said method further comprising, prior to the step of deforming the end portion of the rim, a step of inserting centering means in the rim hole, the centering means having a diameter D*c* equivalent to the diameter of the first section of the counterbored hole minus twice the thickness of the rim, wherein;

$$Dc=d8-(D2e-D2i)$$

an axis of the centering means being maintained in a predefined reference position.

2. A method according to claim 1, wherein the dimensions of the rim hole and of the counterbored hole are predetermined so that a portion of the rim which is pressed into the counterbore:

always bears against the counterbore;

always extends beyond the small diameter d8 of the first section of the counterbored hole; and does not extend beyond the larger diameter D8 of the second section of the counterbored hole; even when the axes of the rim hole and of the counterbored hole are in a position of maximum offset.

3. A method according to claim 1, further comprising holding the first piece in position relative to the second piece prior to the step of inserting the centering means.

4. A method according to claim 1, further comprising holding the first piece and the second piece in contact during insertion of the centering means via respective substantially plane surfaces disposed around the rim hole and the counterbored hole.

5. A method according to claim 1, further comprising holding the first piece and the second piece in contact during insertion of the centering means via respective surfaces having a small amount of regular curvature disposed around the rim hole and the counterbored hole.

6. A method according to claim 1, further comprising deforming and the rim hole by cold deformation.

7. A method according to claim 1, further comprising deforming the counterbored hole by cold deformation.

8. A method according to claim 1, wherein the counterbored hole is circular.

9. A method according to claim 1, wherein the counterbored hole is oblong.

10. The method of claim 1, wherein the plastically deformable material is selected from the group consisting of a ductile metal and metal alloy.

11. The method of claim 1, further comprising, prior to said deforming step, allowing the centering means to move an axis of the rim hole within the clearance value.

* * * * *